US008084928B2

(12) United States Patent
Auer et al.

(10) Patent No.: US 8,084,928 B2
(45) Date of Patent: Dec. 27, 2011

(54) HALOGEN INCANDESCENT LAMP INCORPORATING TWO FILAMENTS FOR DAYLIGHT OPERATION

(75) Inventors: Frank Auer, Herbrechtingen-Bolheim (DE); Gerhard Behr, Altheim (DE); Peter Helbig, Sontheim/Brenz (DE); Christian Seichter, Herbrechtingen (DE); Klaus Wittmann, Sontheim (DE); Sascha Zelt, Beimerstetten (DE)

(73) Assignee: Osram AG, Munich (DE)

( * ) Notice: Subject to any disclaimer, the term of this patent is extended or adjusted under 35 U.S.C. 154(b) by 193 days.

(21) Appl. No.: 12/312,011

(22) PCT Filed: Nov. 8, 2007

(86) PCT No.: PCT/EP2007/062035

§ 371 (c)(1),
(2), (4) Date: Apr. 22, 2009

(87) PCT Pub. No.: WO2008/055948

PCT Pub. Date: May 15, 2008

(65) Prior Publication Data

US 2010/0060160 A1 Mar. 11, 2010

(30) Foreign Application Priority Data

Nov. 9, 2006 (DE) ..... 10 2006 052 950

(51) Int. Cl.
*H01K 9/00* (2006.01)
*H01K 9/08* (2006.01)

(52) U.S. Cl. ..... 313/316; 313/579; 313/272; 315/82; 315/77; 315/291; 315/294

(58) Field of Classification Search ..... 313/315, 313/316, 578–580, 569, 341–345; 315/82, 315/77, 291, 224, 294
See application file for complete search history.

(56) References Cited

U.S. PATENT DOCUMENTS

| | | | | |
|---|---|---|---|---|
| 5,850,124 | A * | 12/1998 | Hasegawa et al. | 313/578 |
| 5,883,468 | A * | 3/1999 | Hobbs et al. | 313/579 |
| 6,262,537 | B1 | 7/2001 | Matsumoto | |
| 2002/0008452 | A1 * | 1/2002 | Coushaine et al. | 313/272 |
| 2002/0135301 | A1 | 9/2002 | Knorr et al. | |
| 2006/0038471 | A1 | 2/2006 | Buhler et al. | |
| 2006/0091775 | A1 * | 5/2006 | Auer et al. | 313/331 |
| 2008/0164813 | A1 | 7/2008 | Wittmann et al. | |
| 2010/0039017 | A1 * | 2/2010 | Auer et al. | 313/316 |

FOREIGN PATENT DOCUMENTS

| | | | |
|---|---|---|---|
| DE | 10 2004 040 417 | A1 | 2/2006 |
| EP | 1 038 728 | A2 | 9/2000 |
| EP | 1 667 205 | A2 | 6/2006 |
| WO | WO 02 07188 | A1 | 1/2002 |
| WO | WO 2006/097058 | A2 | 9/2006 |
| WO | WO 2006/097058 | A3 | 9/2006 |

* cited by examiner

*Primary Examiner* — Mariceli Santiago
(74) *Attorney, Agent, or Firm* — Holtz, Holtz, Goodman & Chick PC

(57) ABSTRACT

The invention relates to a halogen bulb comprising two filaments that are located (21, 22) in a lamp body (10), a first filament (21) being designed for operation at a higher electrical output than the second filament (22). To fulfil a daylight driving function, the second filament (22) is designed to produce an electrical output that is lower by a factor of 2.5 to 4 than the electrical output of the first filament (21) when operating with a standard operating voltage and is designed in such a way that it can be operated with an operating voltage that is lower than the standard operating voltage in order to produce a dimmed position light function.

9 Claims, 1 Drawing Sheet

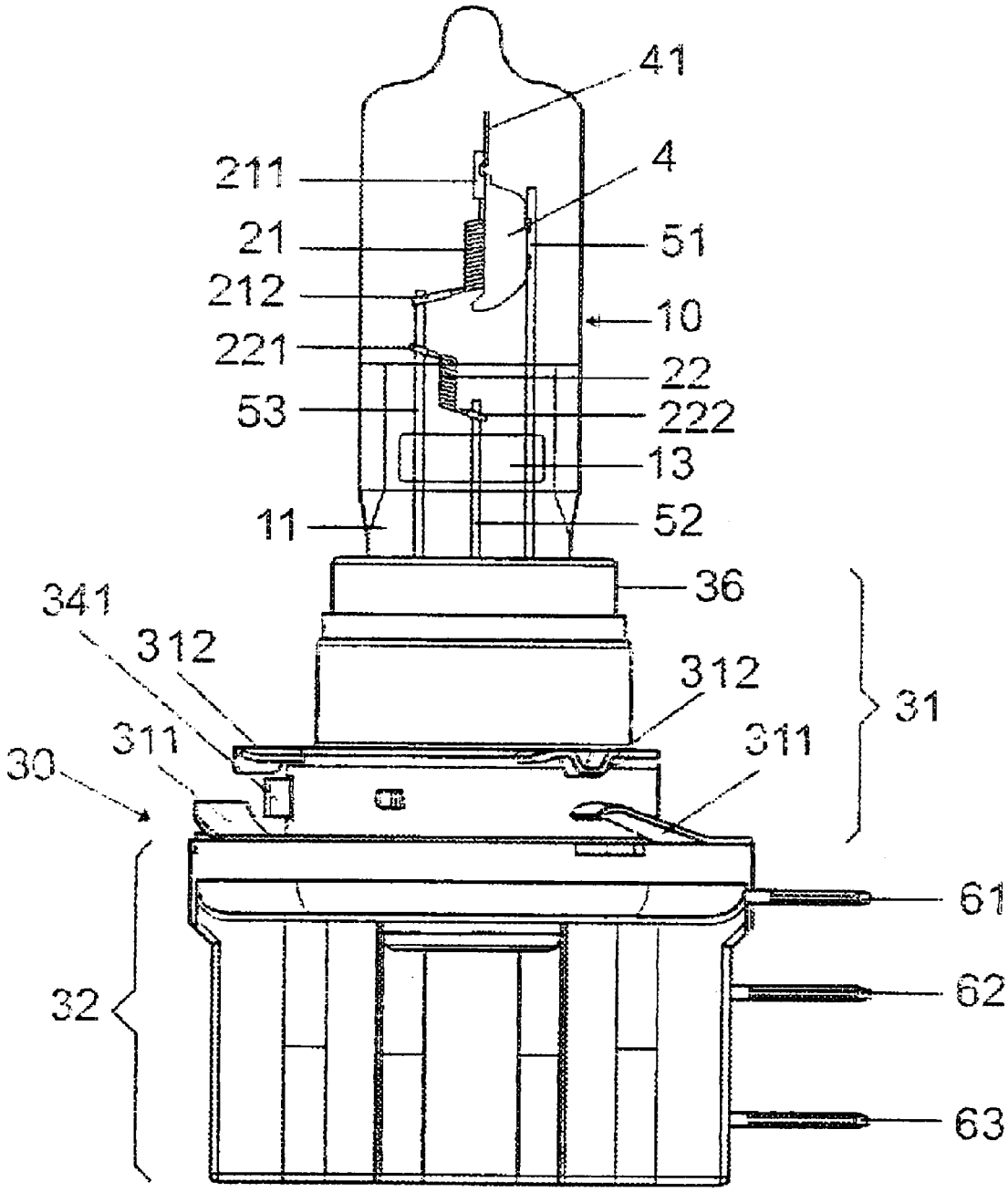
41
211
4
21
51
212
10
221
22
53
222
13
11
52
36
341
312
312
31
311
311
30
61
32
62
63

HALOGEN INCANDESCENT LAMP INCORPORATING TWO FILAMENTS FOR DAYLIGHT OPERATION

This application is a U.S. National Phase Application under 35 USC 371 of International Application PCT/EP2007/062035, filed Nov. 8, 2007, which is incorporated herein in its entirety by this reference.

The invention relates to a halogen incandescent lamp in accordance with the precharacterizing clause of claim 1.

PRIOR ART

Such a halogen incandescent lamp is disclosed, for example, in EP 1 667 205 A2. This laid-open specification describes a halogen incandescent lamp with two incandescent filaments surrounded by a lamp vessel, which incandescent filaments are designed for different electrical powers. The first incandescent filament designed for a relatively high electrical power is used when using the lamp in a motor vehicle headlamp for producing the upper beam, while the second incandescent filament designed for a lower electrical power is provided for producing a daytime running light.

DESCRIPTION OF THE INVENTION

The object of the invention is to provide a generic halogen incandescent lamp in which the low-wattage incandescent filament can be used for a further lighting function, in particular for implementing a positioning light function, in addition to the daytime running light function.

This object is achieved according to the invention by the features of claim 1. Particularly advantageous embodiments of the invention are described in the dependent claims.

The halogen incandescent lamp according to the invention has two incandescent filaments arranged within a lamp vessel, a first incandescent filament being designed for operation at a higher electrical power than the second incandescent filament, and the second incandescent filament, in order to implement a daytime running light function, during operation at a standard operating voltage, being designed for an electrical power which is lower than the electrical power of the first incandescent filament by a factor of 2.5 to 4, and being constructed in such a way that it can be operated in a dimmed state at an operating voltage lower than the standard operating voltage in order to implement a positioning light function. In particular, the second incandescent filament is constructed in such a way that it is operated at the standard operating voltage, i.e. at the rated motor vehicle system voltage of 13.2 V or 28 V, and an electrical power in the range of from approximately 17 W to 22 W for the daytime running light function and can be operated in a dimmed state, i.e. with reduced brightness and at an operating voltage lower than the standard operating voltage, for the positioning light function. There is therefore no need for a separate light source for the positioning light or parking light.

Advantageously, the second incandescent filament is constructed in such a way that it is operated at a voltage in the range of from 35 percent to 95 percent of the standard operating voltage for the positioning light function. As a result, the electrical power of the second incandescent filament is limited in this operating mode to a value in the range of from approximately 12% to 90% of the original value.

The second incandescent filament is preferably in the form of an incandescent filament with a single coil in order to ensure a homogeneous light distribution. The pitch factor of said incandescent filament is preferably in the range of from greater than or equal to 1.65 and less than or equal to 2.0 in order to achieve a low luminance and in order to avoid glare for oncoming traffic in the daytime running light mode. However, the second incandescent filament still emits white light, which meets the requirements for a positioning light, even in the dimmed state, with a reduced operating voltage and a reduced electrical power, despite the comparatively high pitch factor.

The first incandescent filament is preferably in the form of an upper-beam incandescent filament or fog-light incandescent filament.

In order to ensure a tungsten deposition rate which is as low as possible in the two incandescent filaments, the interior of the lamp vessel of the halogen incandescent lamp according to the invention is advantageously filled with a filling gas which contains a noble gas or a noble gas mixture, preferably comprising one or more of the noble gases xenon, krypton and argon and has a coldfilling pressure (i.e. at a temperature of 25 degrees Celsius) in the range of from 3 bar to 18 bar.

The halogen additive to the filling gas preferably comprises a proportion in the range of from 20 ppm to 450 ppm (parts per million), preferably in the form of bromine and/or chlorine in order to prevent blackening of the lamp vessel.

DESCRIPTION OF THE PREFERRED EXEMPLARY EMBODIMENT

The invention will be explained in more detail below with reference to a preferred exemplary embodiment. In the drawing:

FIG. 1 shows a side view of a preferred exemplary embodiment of the halogen incandescent lamp according to the invention.

FIG. 1 illustrates a halogen incandescent lamp according to the invention for a vehicle headlamp. This halogen incandescent lamp has a vitreous, substantially cylindrical lamp vessel 10, with two incandescent filaments 21, 22, which are aligned parallel with respect to the lamp vessel axis and are used for producing an upper beam and a daytime running light, being arranged in the interior of said lamp vessel. The incandescent filaments 21, 22 are in the form of tungsten wires with a single coil. The outgoing filament sections 211, 212 and 221, 222 of the incandescent filaments 21 and 22, respectively, each have a molybdenum foil wound around them, which molybdenum foil acts as a welding aid when welding the outgoing filament sections 211, 212 and 221, 222, respectively, to power supply lines for the incandescent filaments 21, 22. A sealed-off end 11 of the lamp vessel 10 is anchored in a lamp base 30. The first incandescent filament 21 is partially surrounded by an anti-dazzle device 4 formed from sheet molybdenum. The anti-dazzle device 4 is supported by a first power supply wire 51, which, together with a second power supply wire 52 and a third power supply wire 53, is used for supplying energy to the two incandescent filaments 21, 22. For this purpose, a first outgoing filament section 211 of the first incandescent filament 21 is welded by means of projection welding to a welding lug 41 of the anti-dazzle device 4 and, as a result, is electrically conductively connected to the first power supply wire 51 via the anti-dazzle device 4. The second outgoing filament section 212 of the first incandescent filament 21 is welded to the third power supply wire 53. The first outgoing filament section 221 of the second incandescent filament 22 is likewise welded to the third power supply wire 53. The second outgoing filament section 222 of the second incandescent filament 22 is welded to the second power supply wire 52. The three power supply wires 51, 52, 53 each consist of molybdenum and are fixed between two quartz glass webs 13, which are fused with one another, with the result that they are arranged in a common plane. The three power supply wires 51, 52, 53 are passed through the sealed-off end 11 of the lamp vessel 10 and are each electrically conductively connected to one of the three contact lugs 61, 62 or 63. The three contact lugs 61, 62, 63 protrude laterally out of the lamp base 30 and form the electrical terminals of the halogen incandescent lamp. The lamp base 30 is in the form of a metal/plastic base, which has both a metallic base section 31 and a plastic base section 32. The lamp vessel 10 is anchored in the metallic base section 31, and the plastic base section 32 is provided with the electrical contacts 61, 62, 63 of the lamp. In order to fit the halogen incandescent lamp in the headlamp reflector, a metallic spring washer with three spring tabs 311 and three key tabs 312 are used. The rim of the installation opening of the reflector is arranged in the headlamp in clamping fashion between the spring tabs 311 and the key tabs 312 once the lamp has been fitted. A leaf spring 341 is used for laterally fixing the lamp in the installation opening of the headlamp reflector. It acts perpendicularly with respect to the longitudinal extent of the lamp.

The first incandescent filament 21 is in the form of an upper-beam incandescent filament with a single coil and with a rated operating voltage of 13.2 V or 28 V and an electrical power in the range of from approximately 55 W to 80 W. The data relating to the first incandescent filament 21 for a rated operating voltage of 13.2 V are listed in tables 1 and 3 below for the halogen incandescent lamp in accordance with the first and second exemplary embodiments, respectively, of the invention.

The second incandescent filament 22 is in the form of a daytime running light incandescent filament with a single coil and with a rated operating voltage of 13.2 V or 28 V and an electrical power in the range of from approximately 17 W to 22 W. During the positioning light mode, the second incandescent filament 22 is operated, for example by means of a voltage divider or by means of pulse width modulation, at a voltage which is only approximately 70 percent of the above-mentioned operating voltage of 13.2 V or 28 V in order to limit the electrical power of the second incandescent filament 22 to a value from the range of from approximately 5 W to 10 W. The data relating to the second incandescent filament 22 for a rated operating voltage of 13.2 V are listed in tables 2 and 4 below for the halogen incandescent lamp in accordance with the first and second exemplary embodiments, respectively, of the invention.

The pitch is the sum of the distance between two adjacent turns of the incandescent filament and the thickness or the diameter of the filament wire. The pitch factor denotes the quotient of the pitch and the diameter of the filament wire. The core factor is the quotient of the inner diameter of the filament and the diameter of the filament wire.

TABLE 1

Filament data relating to the upper-beam incandescent filament for a rated operating voltage of 13.2 V in accordance with the lamp corresponding to the first exemplary embodiment of the invention:

| | |
|---|---|
| Core factor | 4.96 |
| Pitch | 240 μm |
| Pitch factor | 1.5 |
| Turns number | 17.50 |
| Filament length | 4.40 mm |
| Outer diameter of filament | 1.12 mm |

TABLE 2

Filament data relating to the daytime running light incandescent filament for a rated operating voltage of 13.2 V in accordance with the lamp corresponding to the first exemplary embodiment of the invention:

| | |
|---|---|
| Core factor | 7.09 |
| Pitch | 150 μm |
| Pitch factor | 1.700 |
| Turns number | 28.00 |
| Filament length | 4.2 mm |
| Outer diameter of filament | 0.79 mm |

TABLE 3

Filament data relating to the upper-beam incandescent filament for a rated operating voltage of 13.2 V in accordance with the lamp corresponding to the second exemplary embodiment of the invention:

| | |
|---|---|
| Core factor | 6.0 |
| Pitch | 270 μm |
| Pitch factor | 1.6 |
| Turns number | 15.5 |
| Filament length | 4.3 mm |
| Outer diameter of filament | 1.4 mm |

TABLE 4

Filament data relating to the daytime running light incandescent filament for a rated operating voltage of 13.2 V in accordance with the lamp corresponding to the second exemplary embodiment of the invention:

| | |
|---|---|
| Core factor | 7.5 |
| Pitch | 150 μm |
| Pitch factor | 1.8 |
| Turns number | 27.0 |
| Filament length | 4.2 mm |
| Outer diameter of filament | 0.8 mm |

The invention claimed is:

1. A halogen incandscent lamp with two incandescent filaments (21, 22) arranged within a lamp vessel (10), a first incandescent filament (21) being designed for operation at a higher electrical power than the second incandescent filament (22), wherein the second incandescent filament (22), in order to implement a daytime running light function, during operation at a standard operating voltage, is designed for an electrical power which is lower than the electrical power of the first incandescent filament (21) by a factor of 2.5 to 4, and wherein the second incandescent filament (22) is in the form of an incandescent filament with a single coil and has a pitch factor in the range of from greater than or equal to 1.65 to less than or equal to 2.0 and is constructed in such a way that it can be operated in a dimmed state at an operating voltage lower than the standard operating voltage in order to implement a positioning light function.

2. The halogen incandescent lamp as claimed in claim 1, the second incandescent filament (22) being constructed in such a way that it can be operated at a voltage in the range of from 35 percent to 95 percent of the standard operating voltage for the positioning light function.

3. The halogen incandescent lamp as claimed in claim 1 or 2, the first incandescent filament (21) being in the form of an upper-beam incandescent filament or in the form of fog-light incandescent filament.

4. The halogen incandescent lamp as claimed in claim 1, the interior of the lamp vessel (10) being filled with a gas which contains a noble gas or a noble gas mixture, and the coldfilling pressure being in the range of from 3 bar to 18 bar.

5. The halogen incandescent lamp as claimed in claim 4, the filling gas having a halogen additive, and the proportion of the halogens in the filling gas being in the range of from 20 ppm to 450 ppm.

6. The halogen incandescent lamp as claimed in claim 5, the halogens comprising bromine and/or chlorine.

7. The halogen incandescent lamp as claimed in claim 3, the interior of the lamp vessel (10) being filled with a gas which contains a noble gas or a noble gas mixture, and the coldfilling pressure being in the range of from 3 bar to 18 bar.

8. The halogen incandescent lamp as claimed in claim 2, the interior of the lamp vessel (10) being filled with a gas which contains a noble gas or a noble gas mixture, and the coldfilling pressure being in the range of from 3 bar to 18 bar.

9. The halogen incandescent lamp as claimed in claim 8, the filling gas having a halogen additive, and the proportion of the halogens in the filling gas being in the range of from 20 ppm to 450 ppm.

* * * * *